US008944715B2

(12) United States Patent
Yoder

(10) Patent No.: US 8,944,715 B2
(45) Date of Patent: Feb. 3, 2015

(54) SANITARY DISPOSABLE WRITING INSTRUMENT, METHOD OF MAKING AND DISPENSER THEREFORE

(76) Inventor: Timothy Howard Yoder, Columbiana, OH (US)

( * ) Notice: Subject to any disclaimer, the term of this patent is extended or adjusted under 35 U.S.C. 154(b) by 322 days.

(21) Appl. No.: 12/877,565

(22) Filed: Sep. 8, 2010

(65) Prior Publication Data

US 2011/0058886 A1 Mar. 10, 2011

Related U.S. Application Data

(63) Continuation-in-part of application No. 11/412,027, filed on Apr. 26, 2006, now Pat. No. 7,811,019.

(60) Provisional application No. 60/675,200, filed on Apr. 27, 2005.

(51) Int. Cl.

| | |
|---|---|
| ***B43K 23/02*** | (2006.01) |
| ***B43K 23/00*** | (2006.01) |
| ***B43K 5/00*** | (2006.01) |
| ***B43K 8/00*** | (2006.01) |
| ***B43K 15/02*** | (2006.01) |
| ***B43K 19/02*** | (2006.01) |
| ***B43K 19/14*** | (2006.01) |
| ***B43K 19/16*** | (2006.01) |
| ***B43K 23/06*** | (2006.01) |
| ***B43K 29/007*** | (2006.01) |

(Continued)

(52) U.S. Cl.

CPC ..... *B43K 23/001* (2013.01); *B43K 5/005* (2013.01); *B43K 8/003* (2013.01); *B43K 15/02* (2013.01); *B43K 19/02* (2013.01); *B43K 19/14* (2013.01); *B43K 19/145* (2013.01); *B43K 19/16* (2013.01); *B43K 23/06* (2013.01); *B43K 29/007* (2013.01); *B43K 31/00* (2013.01); *B43M 99/008* (2013.01)

USPC ..... 401/131; 401/6; 401/195; 401/52

(58) Field of Classification Search

USPC ..... 401/6, 52, 195, 131; 221/33, 46, 59

See application file for complete search history.

(56) References Cited

U.S. PATENT DOCUMENTS 1,208,701 A 12/1916 Trenner
2,171,188 A * 8/1939 Morris ..... 401/52

(Continued)

OTHER PUBLICATIONS

Rover, Elena, "The Cold Wars", Real Simple Magazine, Dec. 2005—Jan. 2006 Issue, pp. 203-204.

(Continued)

*Primary Examiner* — David Walczak
*Assistant Examiner* — Bradley Oliver
(74) *Attorney, Agent, or Firm* — The Webb Law Firm

(57) ABSTRACT

A sanitary disposable writing instrument for minimizing the transfer of bacteria, viruses and/or chemicals from one person to another including a strip of flexible holding material, a writing implement removably secured to the flexible holding material, and a writing tip associated with the writing implement. At least a second writing instrument can be provided to form a series of removably secured writing instruments wherein removal of one writing instrument from the series causes a next writing instrument to be positioned for removal from the series. Combination dispenser and holding members for dispensing the series of writing instruments in a sanitary manner is also provided. The holding members can be mounted on either a vertical or horizontal support surface and can receive replacement dispensers therein.

21 Claims, 17 Drawing Sheets

(51) Int. Cl.
*B43K 31/00* (2006.01)
*B43M 99/00* (2010.01)

(56) References Cited

U.S. PATENT DOCUMENTS

| | | | | | |
|---|---|---|---|---|---|
| 2,465,876 | A | | 3/1949 | Hornung | |
| 3,168,072 | A | * | 2/1965 | Masakiyo | 401/97 |
| 4,243,338 | A | | 1/1981 | Williams | |
| 4,508,464 | A | * | 4/1985 | Money | 401/6 |
| 4,732,504 | A | * | 3/1988 | Telli | 401/209 |
| 4,738,556 | A | | 4/1988 | Brown | |
| 4,781,306 | A | * | 11/1988 | Smith | 221/33 |
| 5,399,041 | A | | 3/1995 | Chiswell | |
| 5,683,655 | A | | 11/1997 | Carter | |
| 5,722,575 | A | | 3/1998 | Smith | |
| 5,755,355 | A | | 5/1998 | Timmerman et al. | |
| 5,769,213 | A | * | 6/1998 | Chatterton | 206/38 |
| 5,813,786 | A | * | 9/1998 | Fraenkel | 401/195 |
| 5,897,261 | A | * | 4/1999 | Goetz | 401/6 |
| 5,988,918 | A | * | 11/1999 | Johnson | 401/88 |
| 6,422,416 | B1 | * | 7/2002 | Tramontina | 221/45 |
| 7,059,797 | B2 | * | 6/2006 | Sellars | 401/195 |
| 7,172,092 | B2 | * | 2/2007 | Yang et al. | 221/45 |
| 7,290,953 | B2 | * | 11/2007 | Regala | 401/131 |
| 2003/0185615 | A1 | | 10/2003 | Smith | |
| 2004/0003521 | A1 | | 1/2004 | Penn et al. | |
| 2004/0206769 | A1 | * | 10/2004 | Sanders et al. | 221/59 |
| 2005/0254881 | A1 | * | 11/2005 | Zhang | 401/131 |
| 2006/0245815 | A1 | * | 11/2006 | Chakmakian | 401/131 |
| 2008/0061073 | A1 | * | 3/2008 | Laroche | 221/46 |
| 2009/0052973 | A1 | * | 2/2009 | Windorski | 401/195 |
| 2011/0226796 | A1 | * | 9/2011 | Al-Mahnna | 221/46 |
| 2011/0262209 | A1 | * | 10/2011 | Landy | 401/195 |
| 2012/0093564 | A1 | * | 4/2012 | Bosch | 401/52 |

OTHER PUBLICATIONS

Papermate® Advertisement "Guard Against Gross", Flexgrip Elite® anti-bacterial pen protection.

* cited by examiner

SANITARY DISPOSABLE WRITING INSTRUMENT, METHOD OF MAKING AND DISPENSER THEREFORE

CROSS REFERENCE TO RELATED APPLICATIONS

This application is a Continuation-in-Part of U.S. patent application Ser. No. 11/412,027, filed Apr. 26, 2006, entitled Sanitary Disposable Writing Instrument, Method of Making, and Dispenser Therefore, which is related to U.S. Provisional Patent Application No. 60/675,200, filed Apr. 26, 2005, both of which are incorporated herein by reference in their entirety.

BACKGROUND OF THE INVENTION

1. Field of the Invention

This invention is related to the field of sanitary disposable articles and, more particularly, to a sanitary disposable writing instrument, a method of making such writing instrument, and a dispenser therefore, to prevent cross-contamination of bacteria, viruses and/or chemicals from one person to another in public locations.

Numerous studies have been performed to determine the levels of bacteria or microbes found on commonly used products. It has been found that one of the highest levels of bacteria can be found on writing instruments used by the public in medical environments such as doctors offices, medical clinics or hospitals, or other high traffic areas such as hotels, cruise ships, banks, restaurants, stores and the like. In medical environments, when a patient is signing the register or writing down his/her medical history, patients who are usually ill, commonly use the same writing instrument. Transference of bacteria, viruses and/or chemicals can occur between medical personnel amongst themselves, as well as, with other patients. In other public environments, such as hotels, restaurants, or banks, people, who may have a cold or the flu, commonly use the same writing instrument. Thus, cross-contamination of germs from one person to another is very common.

In an article entitled "The Cold Wars" in the December 2005-January 2006 edition of *Real Simple* magazine, the author states that as a means of preventing colds and the flu, one should "keep hands clean by avoiding well-handled objects like the pens at banks and restaurants (bring your own)". Papermate® has also recently developed a product called the FlexGrip® Elite which is a pen having anti-bacterial protection. This product is being marketed as a device to "Guard Against Gross" which is supposed to keep the pen's surface bacteria free.

2. Description of Related Art

U.S. Pat. No. 5,683,655 is directed to an apparatus and method for disinfecting writing instruments for health care professionals which includes a holding means containing disinfecting fluid, an absorbent material pad which is moistened with the disinfecting fluid and a series of slits through the disinfecting pad which enable the writing instrument to be passed therethrough for disinfecting. While this type of device can eliminate the problem of cross-contamination of germs through use of the writing instrument, such device is costly and bulky to move about the office. Also, this device would require routine maintenance thereof and the purchase and replacement of additional disinfecting fluid.

There is a need in the art for an economically feasible single-use writing instrument, which can reduce and/or eliminate the cross-contamination of germs from one person to another when using these "well-handled" objects such as in banks, restaurants, cruise ships, hotels and the like. There is an even greater need in the art for an economically feasible single-use writing instrument in the medical field that can eliminate cross-contamination of bacteria, viruses and chemicals from one patient to another, from healthcare professionals to patients, and from patients back to healthcare professionals. There is also a need in the art for an economically feasible single-use writing instrument that can be used in a "clean" manufacturing environment such as in pharmaceutical manufacturing plants or chemical laboratories. There is also a need in the art for a dispenser for dispensing these writing instruments, which will minimize the transfer of bacteria, viruses and/or chemicals from person to person.

It is therefore a primary object of the invention to provide a sanitary disposable writing instrument that will minimize the cross-contamination of bacteria, viruses, chemicals and the like from one person to another.

It is a further object of the invention to provide a sanitary disposable writing instrument that is useful in the medical field to minimize the transference of germs, viruses, chemicals and diseases from patient to patient, patient to medical personnel and vice versa, and medical personnel to other medical personnel.

It is another object of the invention to provide a sanitary disposable writing instrument that prevents the transference of germs and bacteria between people at public locations such as banks, restaurants, hotels, cruise ships, stores and the like.

It is another object of the invention to provide a sanitary disposable writing instrument that may be used in "clean" manufacturing plants such as pharmaceutical plants and chemical laboratories.

It is yet another object of the invention to provide a sanitary disposable writing instrument that is functional and economically feasible to produce and dispose of after a single use.

It is another object of the invention to provide a sanitary disposable writing instrument that can be conveniently sized so that it may be placed in a variety of locations.

It is an even further object of the invention to provide a sanitary disposable writing instrument that may have an advertisement or coupon removably attached thereto which would supplement the cost of the writing instrument.

It is another object of the invention to provide a dispenser for dispensing a series of sanitary disposable writing instruments that prevent contamination of the writing instruments prior to their individual use.

It is a further object of the invention to provide a mechanically simple, low cost dispenser that allows for easy loading of the series of writing instruments and ready removal therefrom of individual writing instruments.

It is yet another object of the invention to provide a method for forming a series of sanitary disposable writing instruments.

In addition to the various objects and advantages of the invention which have been described in some specific detail above, it should be noted that various other objects and advantages of the present invention will become more readily apparent to those persons who are skilled in the relevant art from the following more detailed description, particularly, when such description is taken in conjunction with the attached drawing Figures and with the appended claims.

SUMMARY OF THE INVENTION

Briefly, and in accordance with the forgoing objects, the invention comprises a sanitary disposable writing instrument for minimizing the transfer of bacteria, viruses and/or chemicals from one person to another. The sanitary disposable writing instrument comprises a strip of flexible holding material having a predetermined size and shape and a first and second portion. A writing implement is provided which has a first end and a second end. The first end of the writing implement extends along and is secured to the first portion of the holding material. The second end of the writing implement extends beyond and in a perpendicular direction with respect to an edge of the holding material to form a writing tip. A grasping means is formed from one of the second portion and the first portion of the holding material. This grasping means allows the user to grasp the writing implement to write with the writing tip. The disposable writing instruments are provided in a series of instruments in the form of either a continuous strip of material having frangible portions between each instrument for easy separation therefrom or in a stack wherein alternating opposing ends of the instruments are attached to one another by means of a pressure sensitive adhesive.

The invention is also directed to a sanitary disposable writing instrument for minimizing the transfer of bacteria, viruses and/or chemicals from one person to another comprising a strip of flexible holding material, a writing implement secured to the flexible holding material, and a writing tip associated with the writing implement. In particular, the strip of flexible holding material has a first portion and a second portion. The writing implement has a first end and a second end wherein at least the first end of the writing implement extends along and is removably secured to the first portion of the holding material. The writing tip is associated with the second end of the writing implement, wherein at least the first end of the writing implement is adapted for removal from the holding material and forms a grasping surface for manipulation thereof and writing therewith.

The invention is also directed to a combination dispenser and holding member for dispensing a series of sanitary writing implements wherein each of the implements comprise a strip of flexible holding material, a writing implement held by the holding material, and a writing tip associated with the writing implement. The combination dispenser and holding member includes a dispenser comprising a container for holding the series of writing implements. The container at least partially encloses the series of writing implements so as to minimize contamination thereof. An open portion extends through a bottom portion of the container and is adapted for feeding the series of writing instruments therethrough and allowing a user to remove a single writing instrument from the container wherein removal of the single writing instrument positions a subsequent writing instrument for removal from the open portion. The holding member comprises a cylindrical holding member having a top opening, a bottom opening, and sidewalls extending between the top opening and the bottom opening. The top opening, bottom opening and sidewalls define a space adapted for receiving the container. The bottom opening is adapted for cooperation with the open portion in the bottom portion of the container to allow access to and removal of the writing instruments. The holding member also includes at least one stop member located with respect to the bottom opening of the holding member to retain the container within the holding member. A mounting member is provided for mounting the holding member to a vertical support surface, such as a wall, door or window.

According to an alternative design, the invention comprises a combination dispenser and holding member for dispensing a series of sanitary writing implements, each of the implements comprising a strip of flexible holding material, a writing implement held by the holding material and a writing tip associated with the writing implement. The combination dispenser and holding member includes a dispenser comprising a container for holding the series of writing implements. The container at least partially encloses the series of writing implements so as to minimize contamination thereof. A top open portion extends through a top portion of the container. The top open portion is adapted for feeding the series of writing instruments therethrough and allows a user to remove a single writing instrument from the container wherein removal of the single writing instrument positions a subsequent writing instrument for removal from the open portion. A bottom open portion extends through a bottom portion of the container. This bottom open portion is adapted for receiving a biasing member therein. The device further includes a cylindrical holding member having a top portion including an opening extending therethrough, a bottom closed portion, and sidewalls extending between the top portion and the bottom portion. The top portion, bottom portion and sidewalls define a space adapted for receiving the container. The top opening is adapted for cooperation with the top open portion of the container to allow access to and removal of the writing instruments. A biasing member is associated with the cylindrical holding member. The biasing member is adapted for entering within the bottom open portion of the container and applying a biasing force to the series of writing implements. A mounting member is provided for mounting the holding member to a horizontal support surface, such as a desk or counter.

DETAILED DESCRIPTION OF THE INVENTION

Figure 1:
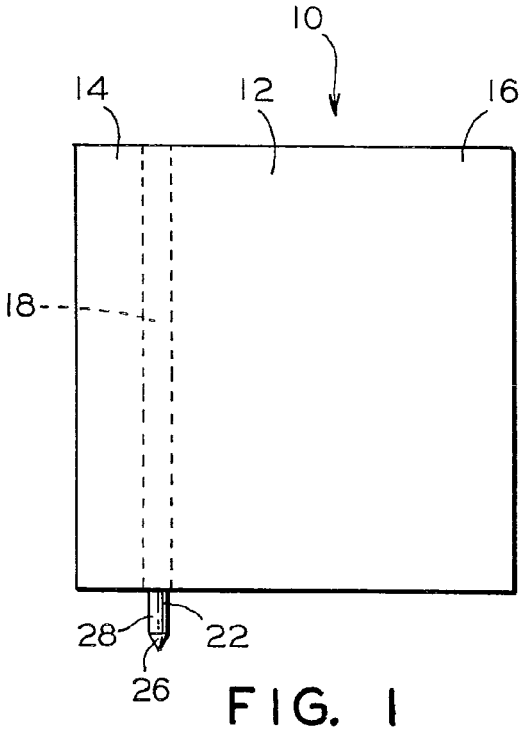
FIG. 1 shows a top view of the sanitary disposable writing instrument according to a first embodiment of the invention.

Before describing the invention in detail, the reader is advised that, for the sake of clarity and understanding, identical components having identical functions have been marked where possible with the same reference numerals in each of the Figures provided in this document.

Referring now to FIGS. 1-2 and 5-6, there is shown the sanitary disposable writing instrument, generally indicated as 10, for reducing the transfer of bacteria, viruses and/or chemicals from one person to another. The sanitary disposable writing instrument 10 comprises a strip of flexible holding material 12 having a predetermined size and shape. The strip of holding material 12 may be formed from any well known material such as paper, plastic, neoprene, and the like. The strip of holding material 12 has a first portion 14 and a second portion 16. A writing implement 18 having a first end 20 and a second end 22 is provided. The first end 20 of the writing implement 18 extends along and is secured to the first portion 14 of the holding material 12. This writing implement 18 is secured to the holding material 12 by any well known means such as adhesive, fusion, and the like. The second end 22 of the writing implement 18 extends beyond and in a perpendicular direction with respect to an edge 24 of the holding material 12 to form a writing tip 26. A writing means 28 is associated with the writing tip 26. Any well known writing means may be employed as the writing implement 18, such as a pen, pencil, marker, and the like. Preferably the writing implement 18 comprises a hollow tube and the writing means comprises either an ink source or graphite filled member, which is capable of being inserted within the hollow tube. A grasping means 30 is formed from one of the second portion 16 and the first portion 14 of the holding material 12. This grasping means 30 acts as an anchor and enables a user to grasp one of the first portion 14 and the second portion 16 of the holding material 12 within his/her hand and write with the writing tip 26.

Figure 2:
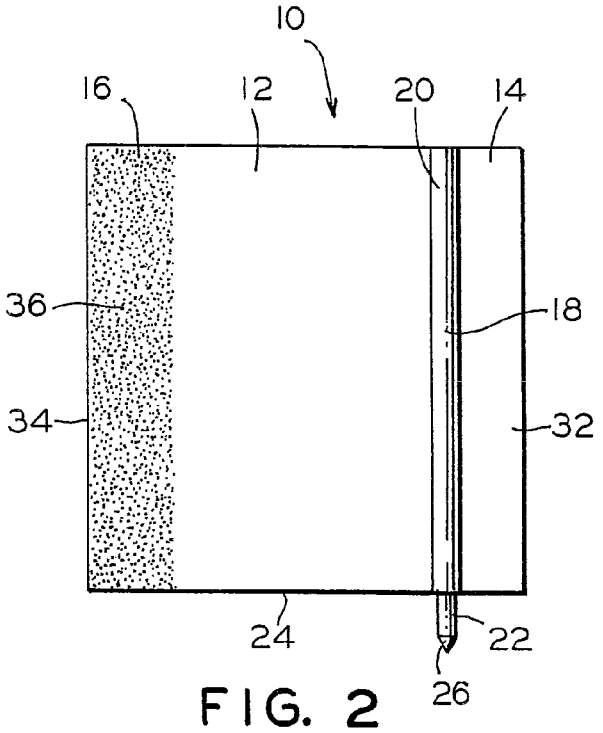
FIG. 2 shows a bottom view of the sanitary disposable writing instrument of FIG. 1.

According to a first embodiment, as illustrated in FIGS. 1-2, the first portion 14 of the holding material 12 can comprise a first edge area 32 of the holding material 12 and the second portion 16 of the holding material 12 can comprise a second edge area 34 of the holding material 12. A securing means 36, such as a pressure sensitive adhesive, can be provided along the second edge 34 of the holding material.

Figure 4A:
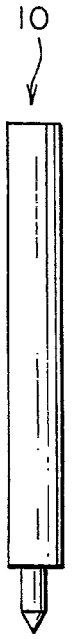
FIG. 4A shows the sanitary disposable writing instrument of FIG. 1 rolled into a final form to produce a grasping portion for a user to grasp and write with the writing instrument.
Figure 4B:
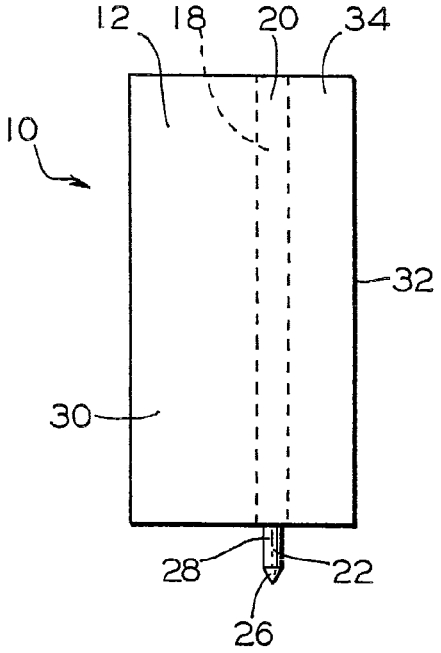
FIG. 4B shows the sanitary disposable writing instrument of FIG. 1 folded into a final form to produce a grasping of FIG. 1 folded into a final form to produce a grasping portion for a user to grasp and write with the writing instrument.

The sanitary disposable writing instrument may be prepared for use by several methods. The first of these methods are shown in FIG. 4A wherein the second edge area 34 is rolled up into a cylinder 38 to enclose the writing implement 10 therein and to form an area for the user to grasp the instrument. The second edge area 34 is secured by means of the pressure sensitive adhesive 36. The second method of preparation is shown in FIG. 4B. This method can be employed for users who are in a hurry and may only need to use the implement to write something quick, such as signing their name. In this method, the user simply folds the second edge area 34 onto the first edge area 32 to enclose the writing implement and form the grasping means 30. Again, the pressure sensitive adhesive 36 provided on the second edge area 34 secures the second portion 16 of the strip 12 to the first portion 14.

Figure 4C:
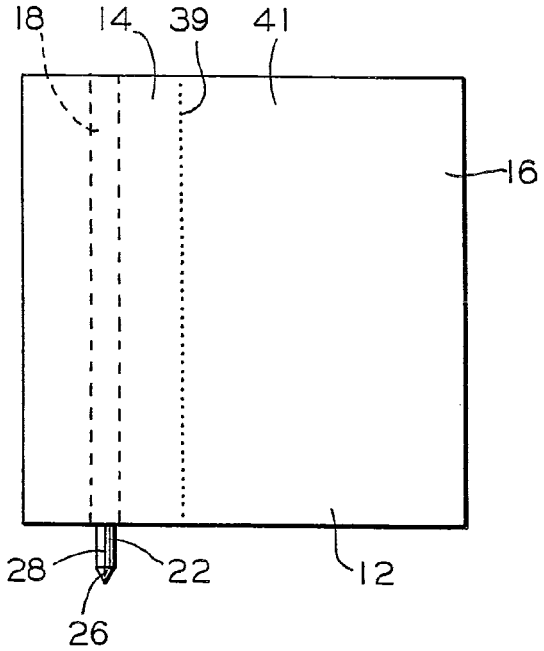
FIG. 4C shows the sanitary disposable writing instrument of FIG. 1 wherein a portion of the writing instrument is removable to form a coupon or advertisement.

As shown in FIG. 4C, a modification may be made to the sanitary disposable writing instrument wherein the first portion 14 of the holding material 12 comprises a first edge area 32 of the holding material 12. This first edge area 32 of the holding material 12 is capable of being one of folded and rolled to enclose the writing implement 18 and to form the grasping means 30. The second portion 16 of the holding material 12 is removable from the first portion by means of a frangible and/or perforated area 39 extending between the first 14 and second 16 portion. This second portion 16, which can be removed from the first portion 14, can be in the form of a coupon or advertisement 41 that the pen user may remove from the sanitary disposable writing instrument. Note that although the pressure sensitive adhesive would not be available for securing this first portion 14 in place, this first portion 14 of the holding material 12 can be held by the user simply by the action of writing with the instrument 10. This advertising product could supplement the cost of the disposable writing instruments and provide a novel technique for store, restaurant, and hotel owners to advertise their product as well as reduce their cost of purchasing the disposable writing instruments 10.

Figure 3:
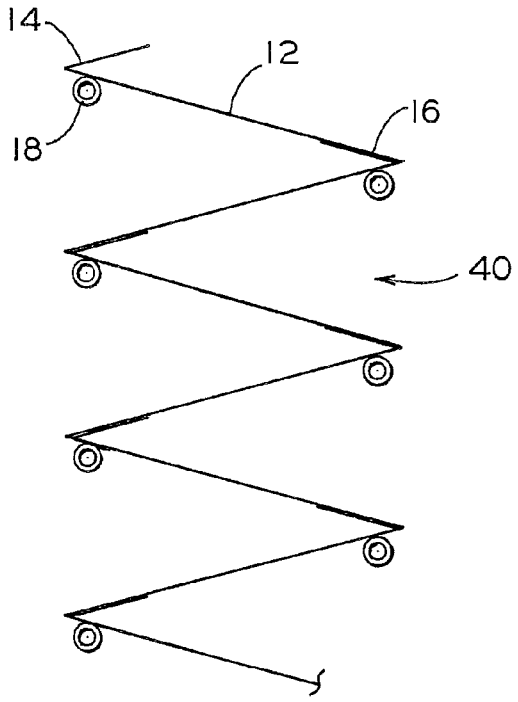
FIG. 3 shows a series of the sanitary disposable writing instrument of FIG. 1.

As shown in FIG. 3, at least a second writing instrument 10 may be secured thereto to form a series, generally indicated as 40, of sanitary disposable writing instruments 10. This series 40 of sanitary disposable writing instruments 10 are preferably secured to one another by means of the pressure sensitive adhesive strip 36 which runs along the second edge area 34 of the holding material 12.

Figure 6:
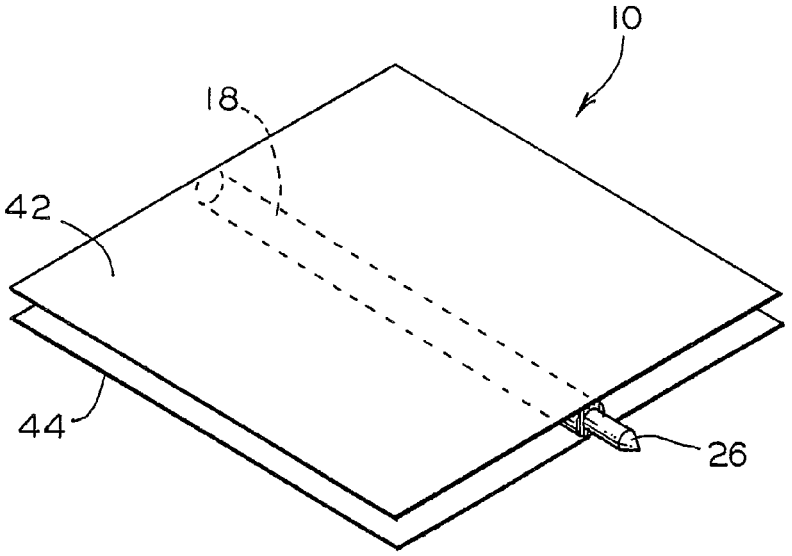
FIG. 6 shows a side view of the sanitary disposable writing instrument of FIG. 5.
Figure 5:
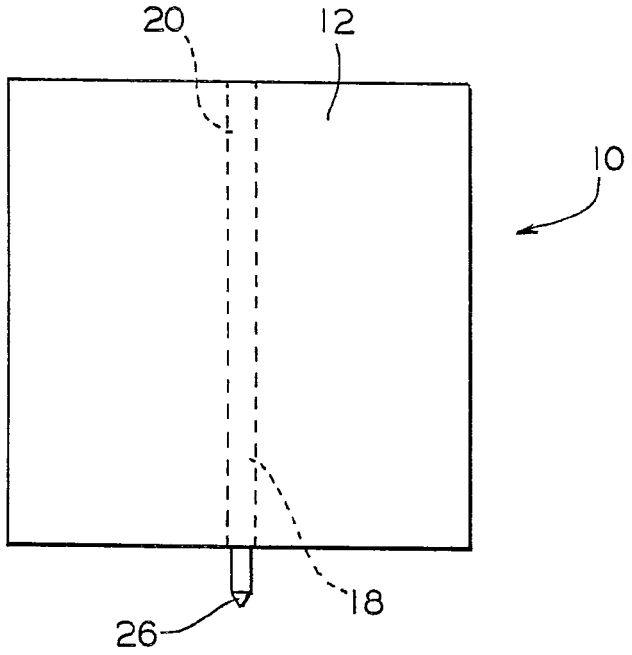
FIG. 5 shows a top view of the sanitary disposable writing instrument according to a second embodiment of the invention.
Figure 7A:
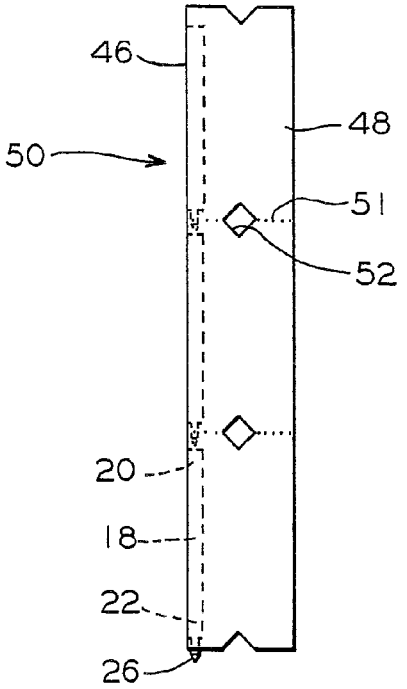
FIG. 7A shows a series of the sanitary disposable writing instruments of FIGS. 5 and 6 wherein the writing implement is positioned along a side portion of the holding material.
Figure 7B:
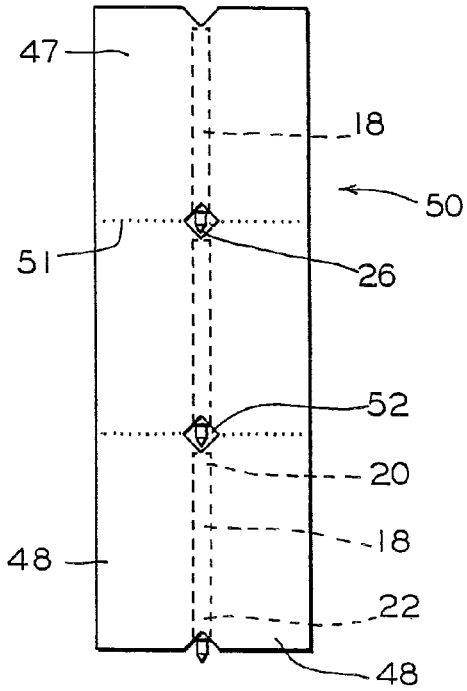
FIG. 7B shows a series of the sanitary disposable writing instruments of FIGS. 5 and 6 wherein the writing implement is positioned along a center portion of the holding material.

According to an alternative embodiment, as illustrated in FIGS. 5-6, the strip of holding material 12 can comprise a pair of layers 42, 44 and the writing implement 18 is enclosed and sealed between these layers 42, 44. These layers may be sealed by any well known means, such as adhesive, plastic fusion, and the like. As shown in FIGS. 7A and 7B, the first portion 14 of the strip 12, which holds the writing implement 18, can either be an edge portion 46 or a center portion 47. The second portion 16 can be the surrounding portion 48 of the holding material 12 that assists the user in grasping the writing instrument 10.

Figure 14:
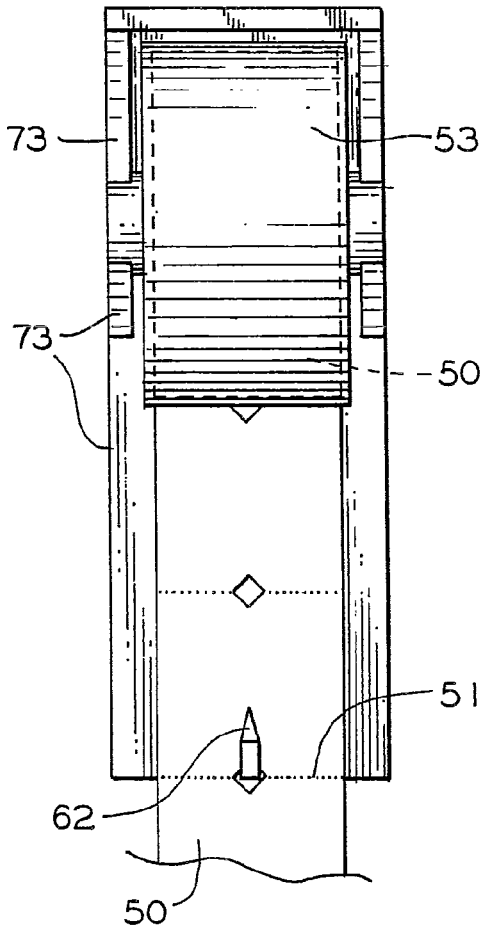
FIG. 14 shows a top view of the dispenser of FIG. 13.
Figure 13:
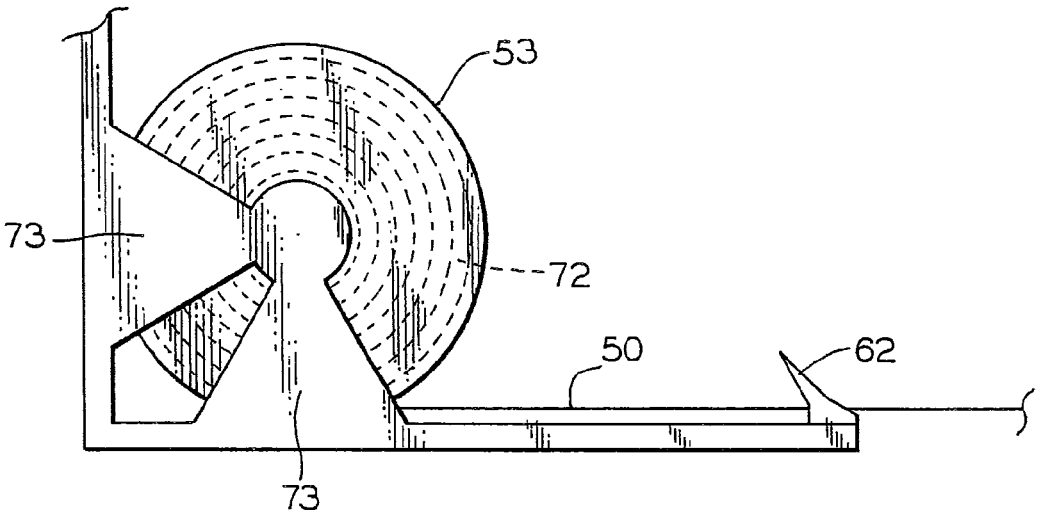
FIG. 13 shows a side view of a dispenser for dispensing a series of the sanitary disposable writing instruments according to a third embodiment.

According to this embodiment, multiple writing instruments 10 may be secured to one another to form a series, indicated as 50 in FIGS. 13-14. The instruments 10 are secured to one another by means of frangible and/or perforated areas 51 between the strip of flexible material 12. A slit 52 in the frangible area 51 is provided to assist in the separation of the individual writing instruments 10. In the design wherein the writing implement 18 extends along a center portion 47 of the layers 42, 44 this slit 52 is provided in the area of the writing tip 26. In the design of the writing instrument 10 wherein the writing implement 18 extends along an edge portion 46 of the layers 42, 44 this slit 52 should still be provided in the center of the frangible area 51 to allow for easy and even separation of the writing instrument 10 from the subsequent instrument 10 in the series 50.

A dispenser, as illustrated in FIGS. 8-14, is provided for dispensing the series of sanitary writing instruments 10. The dispenser comprises a container 53 having a size and shape capable of holding a series of writing instruments 40, 50 and preventing contamination of the writing instruments 40, 50. An open portion 54 is provided in the container 53. This open portion 54 has a size and shape capable of feeding the series of writing instruments 40, 50 therethrough and allowing a user to remove a single writing instrument 10 from the container 53 and to leave a subsequent writing instrument 10 in a position for removal from the open portion 54.

Figure 10:
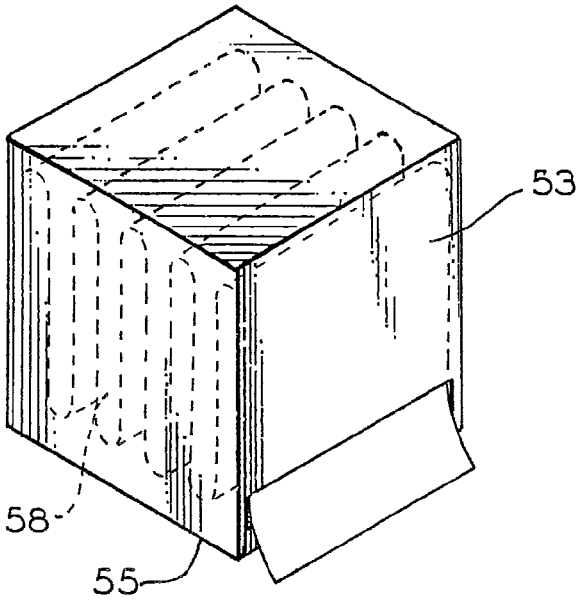
FIG. 10 shows the dispenser of FIG. 8 including a series of the sanitary disposable writing instruments accordion folded within the dispenser.
Figure 8:
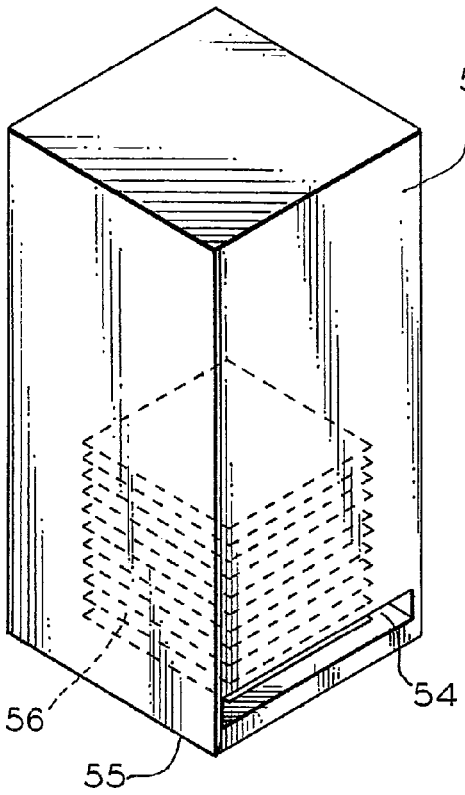
FIG. 8 shows a side perspective view of a dispenser for dispensing a series of the sanitary disposable writing instruments according to a first embodiment.

According to a first embodiment, as illustrated in FIGS. 8 and 10, the size and shape of the container 53 can be a box. This box is capable of holding a series of writing instruments 40, 50 in two forms. The open portion 54 is provided on a bottom portion 55 of the box 53. The first form is a stack 56 of separated double layer writing instruments 10, as illustrated in FIGS. 5-6, which are positioned in the box and fed from the bottom open portion 54. Another form is shown in FIG. 10, wherein a series of the double layer writing instruments 50 are provided in attached form, such as those in FIGS. 7A and 7B. A group of approximately ten to twelve individual instruments are accordion folded onto one another as shown by 58 in FIG. 10, and fed through the bottom open portion 54 of the container 53. In these two methods, subsequent writing instruments 10 are fed to the open portion 54 by gravity and/or are fed to the open portion 54 by the application of a pulling force by the user on a previous writing instrument 10 during removal therefrom.

Figure 9:
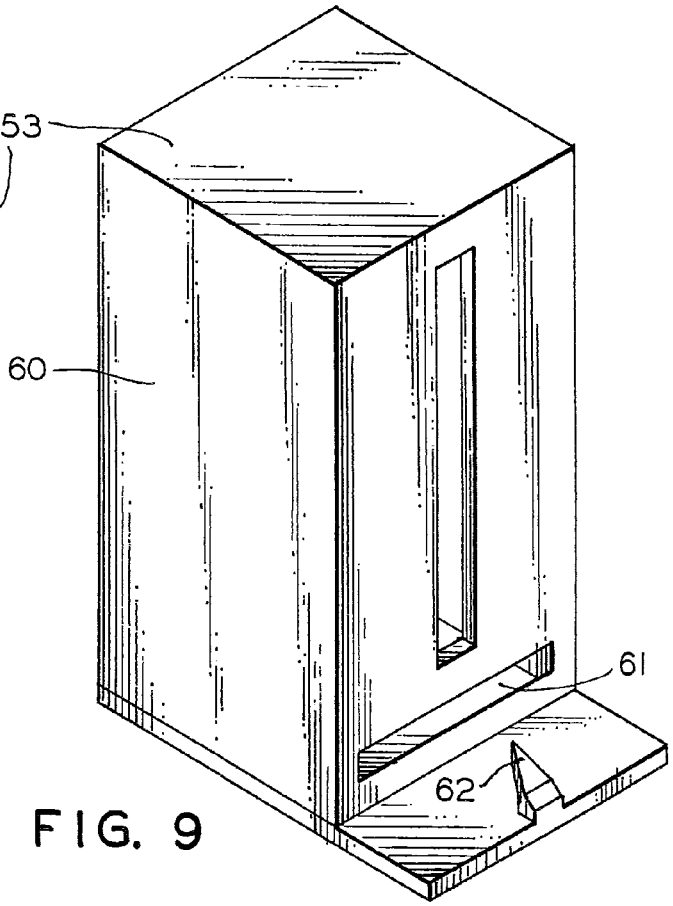
FIG. 9 shows a holding means for the dispenser of FIG. 8.

A holder 60, as shown in FIG. 9, may be provided for holding the box-shaped container 53. This holder may be mounted to a surface, such as the wall or a counter. The holder 60 can be formed from a stable material such as plastic or metal so as to sufficiently support the box-shaped container 53 and allow for replacement boxes 53 of the writing instruments 10 to be placed therein. A bottom opening 61 is provided which corresponds with the opening 54 of the box shaped container 53. A separating tab 62 is provided on the holder 60. This separating tab 62 extends in a perpendicular direction with respect to the feed of the series of writing instruments 50. The separating tab 62 is capable of entering the slit portion 52 of the frangible area 51 between each of the writing instruments 10 to assist the user in separating a single writing instrument 10 from subsequent writing instruments 10.

Figure 11:
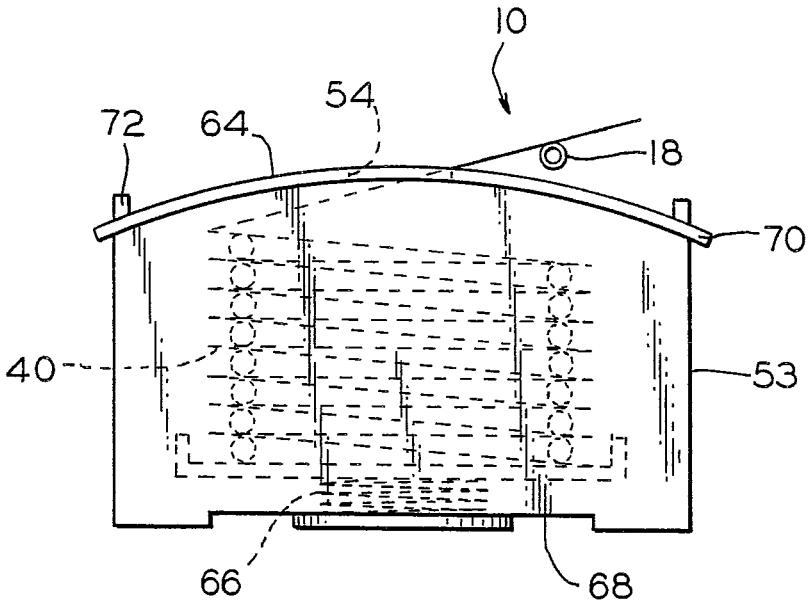
FIG. 11 shows a side view of a dispenser for dispensing a series of the sanitary disposable writing instruments according to a second embodiment.
Figure 12:
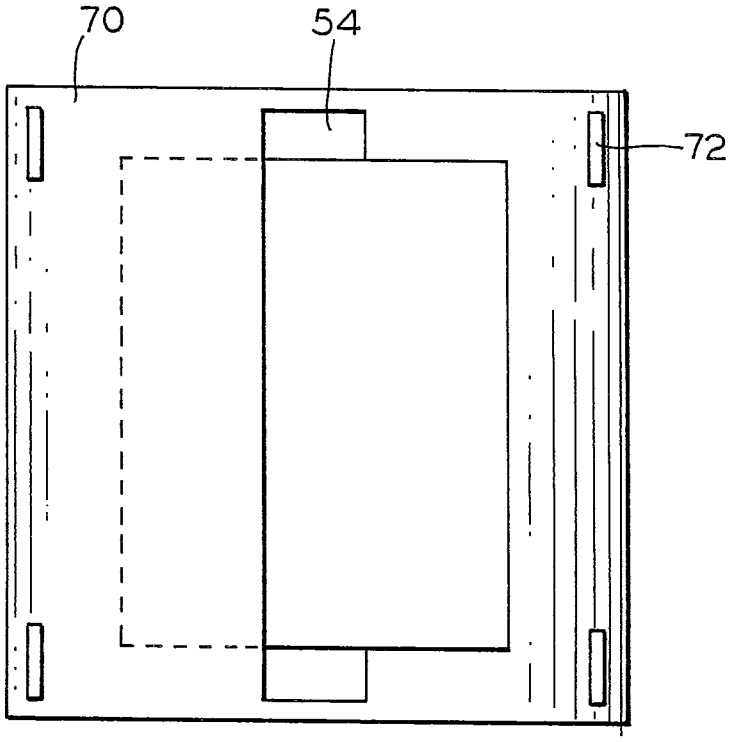
FIG. 12 shows a top view of the dispenser of FIG. 11.

As shown in FIGS. 11-12, according to a second embodiment, the open portion 54 comprises an opening in a top portion 64 of the box shaped container 53. The dispenser further includes a spring 66 in a bottom portion 68 of the box shaped container 53 for applying an upward force to the series 40 of writing instruments in order to feed the instruments 10 through the open portion 54. This dispenser is used primarily for dispensing the series 40 of disposable writing instruments 10 illustrated in FIGS. 1-3 and 4A-4C. This dispenser is designed to have a removable lid 70 secured to the box 53 via locking tabs 72 to enable loading of and/or replacement supplies of the series of writing instruments into the box shaped container 53

According to a third embodiment of the dispenser, as shown in FIGS. 13-14, the size and shape of the container 53 is capable of holding a roll 72 of disposable writing instruments 10. Mounting means 73 are provided for holding the roll 72 within the container 53. These mounting means 73 are capable of mounting the roll 72, with or without container 53, onto the wall or on a stand. This embodiment is designed for dispensing the series of writing instruments 50 illustrated in FIGS. 7A and 7B wherein the instruments are supplied as a continuous strip having a frangible area 51 between each of the disposable writing instruments. As stated above, a slit 52 is provided in a portion of the frangible area between the instruments 10, preferably in the center of this area. A separating tab extending in a perpendicular direction with respect to the feed of the series 50 of the writing instruments 10 is capable of entering this slit 52 between each of the writing instruments 10 to assist the user in evenly separating a single writing instrument 10 from subsequent writing instruments in the series.

The present invention also teaches a method of forming a series 40, 50 of disposable writing instruments capable of minimizing the transfer of bacteria, viruses and/or chemicals from one person to another. The method comprises the steps of continuously feeding at least one sheet 74 of holding material 12, continuously feeding a hollow holding tube 78 in a parallel direction with respect to the at least one sheet 74 of holding material 12, securing the holding tube 78 to the at least one sheet via the application of adhesive and/or heat via a sealing means 79, forming frangible areas via a perforating means 80 in the at least one sheet 74 of holding material 12 and the hollow holding tube 78 to form a series of separable writing instruments 40, 50, and inserting a writing or means 28 within the hollow holding tube 78. The perforating means 80 or a separate cutting member 81 is provided for cutting the hollow tube into individual writing implements 18.

Figure 15:
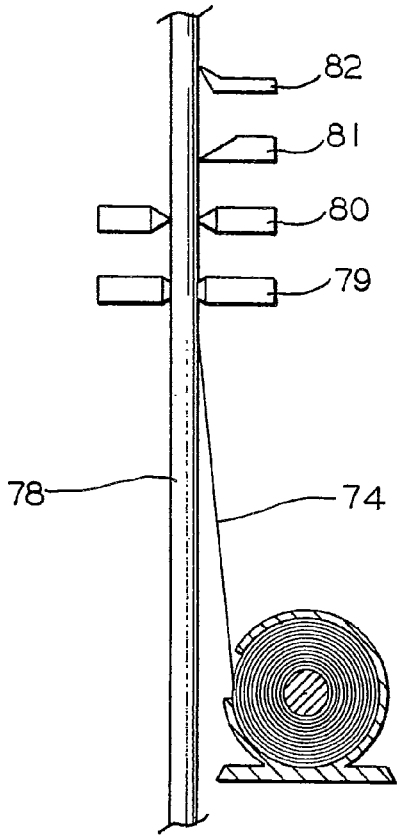
FIG. 15 shows a method of forming a series of sanitary disposable writing instruments of the invention.

As shown in FIG. 15, the at least one sheet 74 of holding material 12 comprises a single sheet and the method includes the step of folding, as shown by 82, at least an edge portion of the single sheet onto itself and sealing to enclose the holding tube 78.

Figure 16:
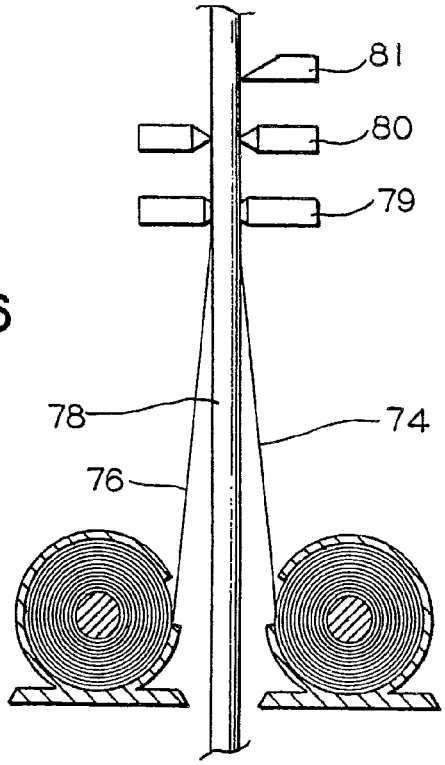
FIG. 16 shows an alternative method of forming a series of sanitary disposable writing instruments of the invention.

According to an alternative method, as shown in FIG. 16, at least two sheets 74, 76 can be fed and the holding tube 78 is fed between these at least two sheets 74, 76 and the sheets are sealed together via sealing means 79 to enclose the holding tube therebetween. Perforating means 80 and cutting means 81 are also provided.

The writing source or means 28 can include any well know material such as an ink filled tip or a graphite tip 26. The method further includes the step of securing the writing tip 26 in an end portion of the holding tube 78 by any well-known means.

To produce the series 40 of writing instruments illustrated in FIG. 3, an additional step of providing lines of pressure sensitive adhesive 36 onto the at least one sheet 74 of flexible material is required. This embodiment also requires the step of separating the writing instruments from one another and attaching them at alternating opposing ends by means of this pressure sensitive adhesive 36.

Figure 17:
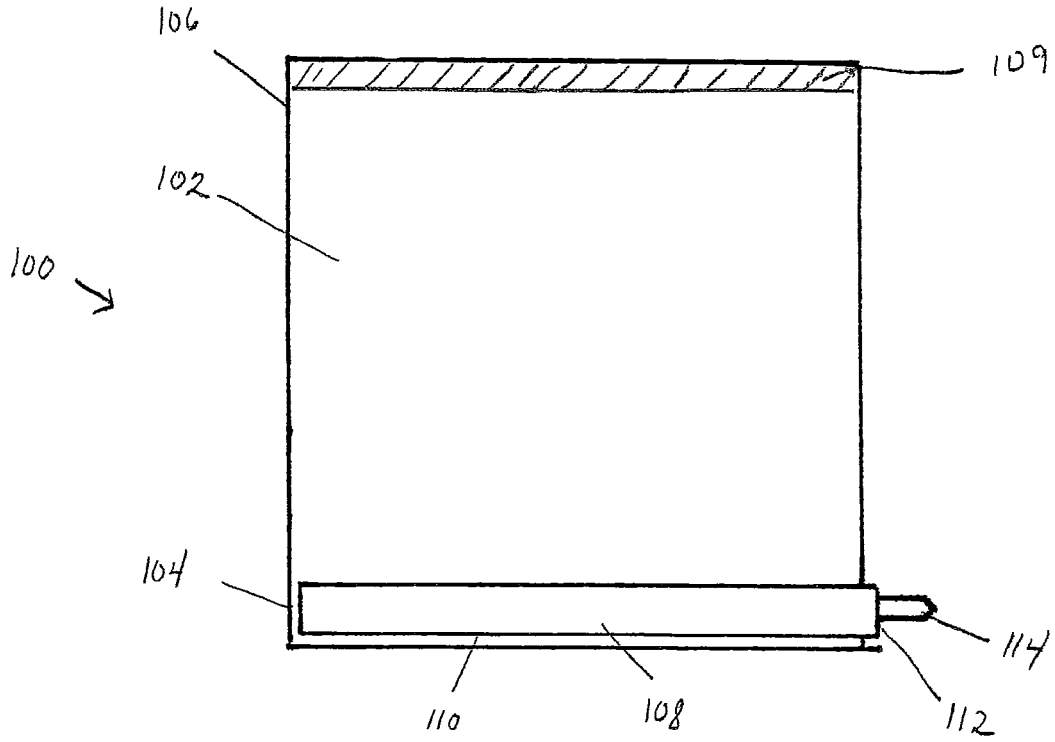
FIG. 17 shows a front view of a sanitary disposable writing instrument according to another embodiment of the invention.

Reference is now made to FIG. 17, which shows a front view of a sanitary disposable writing instrument, generally indicated as 100, according to another embodiment of the invention. In this design, the writing instrument 100 comprises a strip of flexible holding material 102, having a first portion 104 and a second portion 106. A writing implement 108 is removably secured to the flexible holding material 102. This writing implement includes at least a first end 110 and a second end 112 wherein the first end 110 extends along and is removably secured to the first portion 104 of the holding material 102. A writing tip 114 is associated with the second end 112 of the writing implement 108 wherein at least the first end 110 of the writing implement is adapted for removal from the flexible holding material 102 and forming a grasping surface for manipulation of the writing implement 108 for writing with the writing tip 114.

The writing implement 108 is removably secured to the flexible holding material 102 by any well known material including rubber cement, a pressure sensitive adhesive, and the like. According to one embodiment, the second portion 106 of the flexible holding material 102 can include written material thereon.

Figure 18:
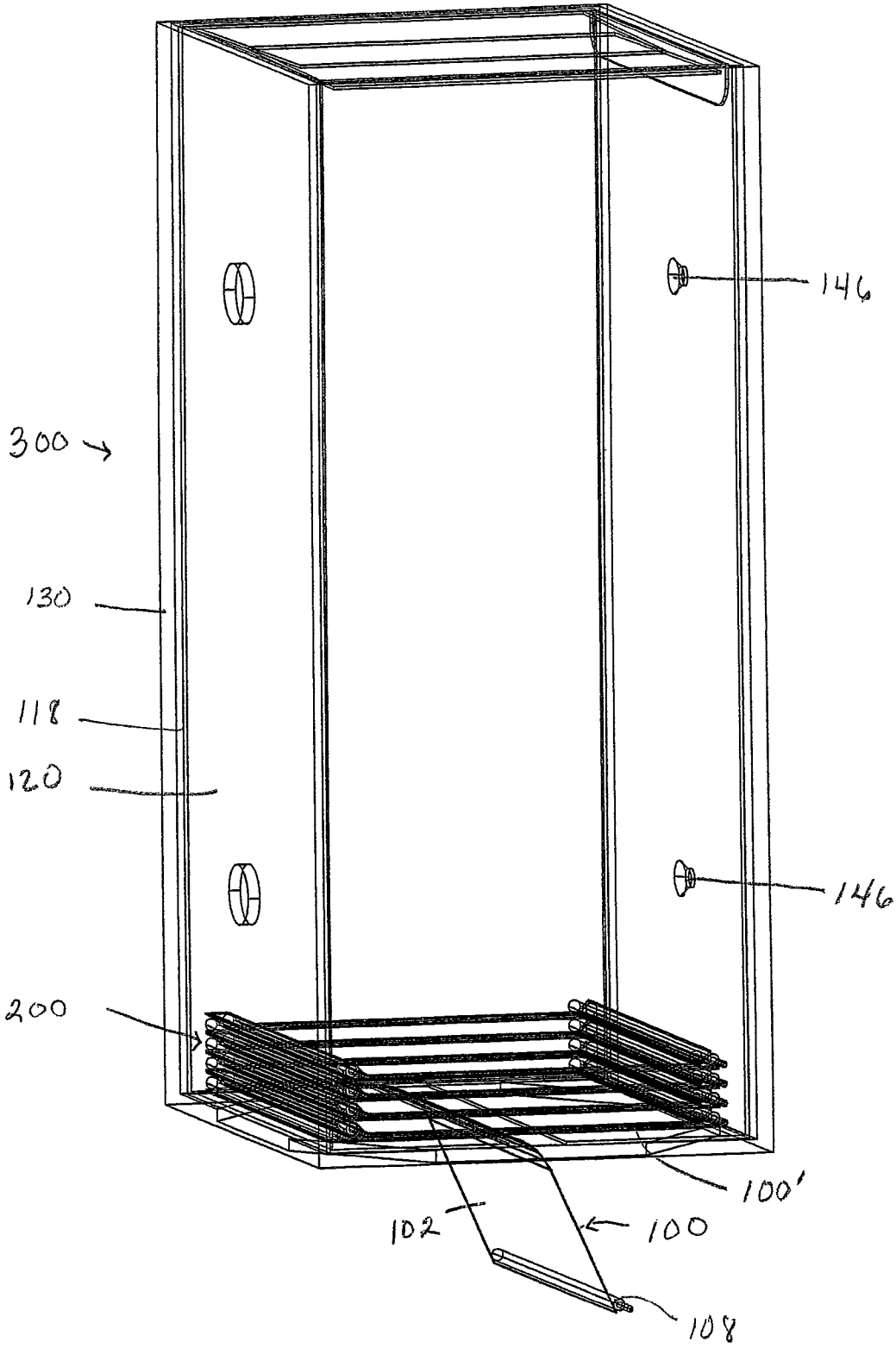
FIG. 18 shows a front perspective view of a combination dispenser and holding member, including the interior components and contents of the dispenser/holding member for dispensing a series of sanitary disposable writing instruments according to an alternative design of the invention.
Figure 19:
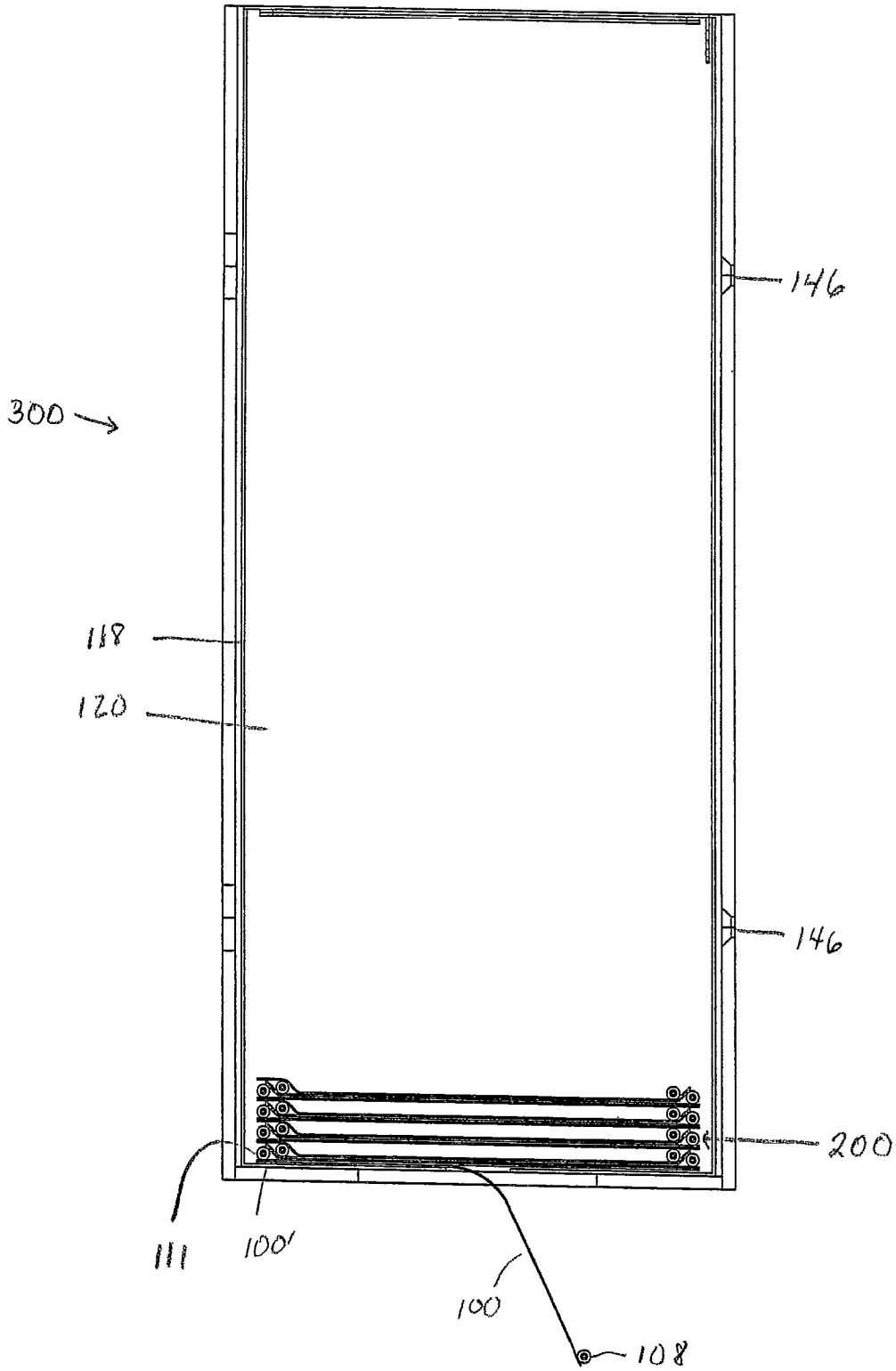
FIG. 19 shows a side view of the combination dispenser and holding member of FIG. 18.

As shown in FIGS. 18 and 19, at least a second writing instrument can be removably secured to the first writing instrument 100 to form a series of sanitary disposable writing instruments, generally indicated as 200, in FIG. 18. The series of writing instruments 200 comprises a plurality of individual writing instruments 100 stacked on upon another wherein removal of one of the writing instruments 100 from the series 200 causes a next writing instrument 100' to be positioned for removal from the series 200. This can be achieved by including an adhesive for adhesively securing alternate edge portions of the flexible holding material 102 to one another. These alternate edge portions can be located along the edge 109 of the second portion 106 of the flexible holding material 102. The adhesive material located along edge 109 of writing instrument 100 is adapted for contacting a back surface 111 of the first portion 104 of the flexible holding material 102 of the subsequent writing instrument 100', as shown in FIG. 19. The adhesive used for affixing the series of writing instruments 200 can comprise an easily releasable material such as rubber cement, a pressure sensitive adhesive, and the like.

With continuing reference to FIGS. 18 and 19, there is shown a combination dispenser and holding member, generally indicated as 300, for dispensing the series of sanitary writing instruments 200. The combination dispenser and holding member 300 comprises a dispenser, generally indicated as 118, shown in FIG. 18B including a container 120 for holding the series of writing instruments 200. The container 120 can be in the form of a sleeve-like member that at least partially encloses the series of writing instruments 200 so as to minimize contamination of the writing instruments 100. An open portion 122 extends through a bottom portion 124 of the container. This open portion 122 is adapted for feeding the writing instruments 100 there through and allowing a user to remove a single writing instrument 100 from the container 120 wherein removal of the single writing instrument 100 positions a subsequent writing instrument 100' for removal from the open portion 122. This container 120 can be formed from any well known material. For example, the container 120 can be formed from an inexpensive disposable material, such as plastic or cardboard and the series of writing instruments 200 can be packaged in the container 120 in a sterile manufacturing environment. The container 120 can include a viewing member by which one can view the amount of writing instruments remaining in the container 120, alerting the user that replacement thereof is necessary. This viewing member can be a window or opening along a side of the container 120 or it can be achieved through the use of a transparent plastic sleeve for forming the container 120.

Figure 18A:
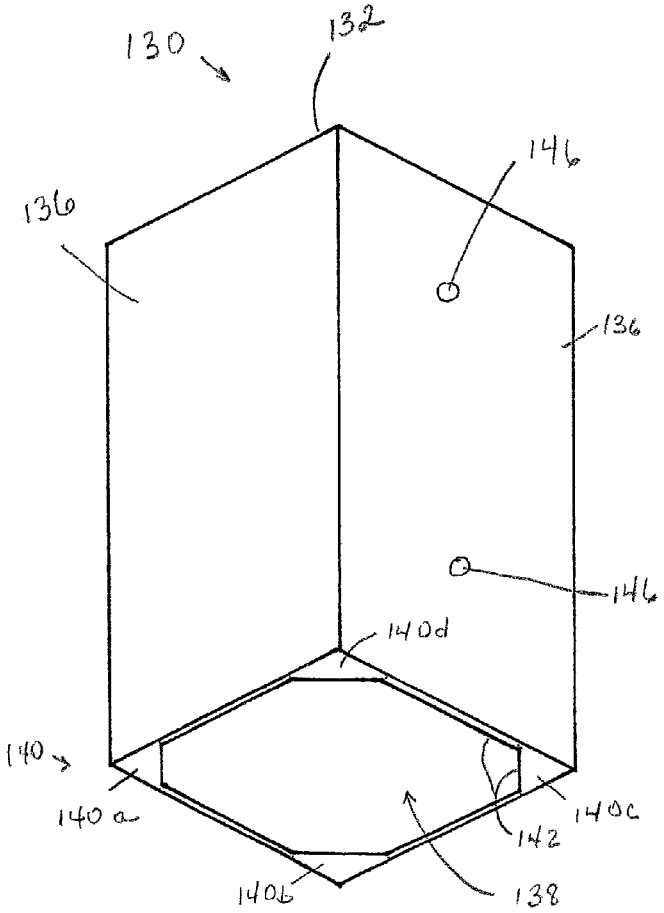
FIG. 18A shows a back, outer perspective view of the dispenser of FIG. 18.
Figure 18B:
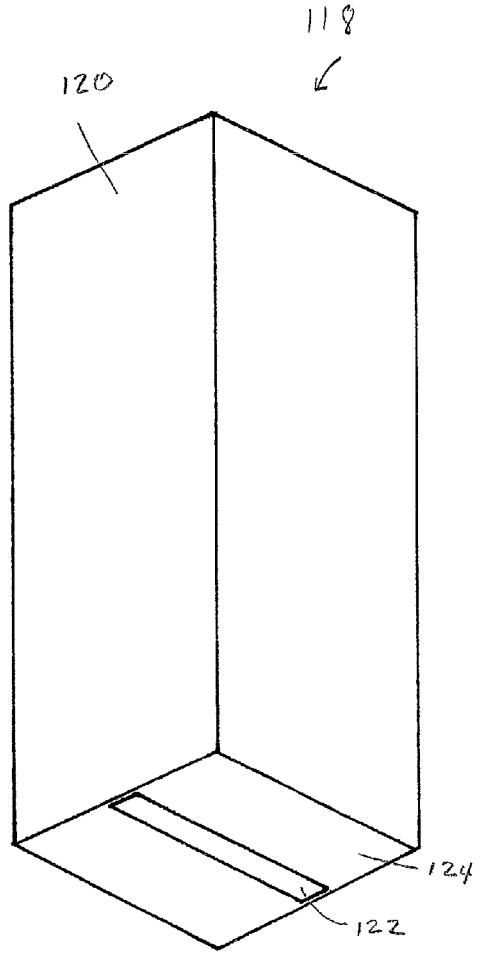
FIG. 18B shows a back, outer perspective view of the holding member of FIG. 18.

With continuing reference to FIGS. 18 and 19 and, in particular with reference to FIG. 18A, the combination dispenser and holding member 300 further includes a cylindrical holding member 130 having a top opening 132, a bottom opening 134, and sidewalls 136 extending between the top opening 132 and the bottom opening 134. The top opening 132, bottom opening 134 and sidewalls 136 define a space, generally indicated as 138, adapted for receiving the container 120. The bottom opening 134 is adapted for cooperation with the open portion 122 in the bottom portion 124 of the container 120 to allow access to and removal of the writing instruments 100. The holding member 130 can be formed from any well-known material, but preferably is formed from a hard plastic material. The material can be of any color and can be transparent or translucent. The holding member may also include any type of indicia thereon, such as advertising information, holiday décor, decorative designs, and the like.

At least one stop member 140 is located with respect to the bottom opening 134 of the holding member 130 to retain the container 120 within the holding member 130. According to one embodiment, the at least one stop member 140 comprises a plurality of stop members 140*a*, 140*b*, 140*c*, 140*d* located adjacent the bottom opening 134 of the holding member 130. This plurality of stop members 140*a*-140*d* can be located in the corners of the holding member 130. Preferably, the at least one stop member 140 is such that it produces a reduced opening perimeter 142 within the bottom opening 134 of the holding member 130 wherein the reduced opening perimeter is smaller in size than an outer perimeter of the bottom portion 124 of the container 120. The holding member 130 is adapted for receiving replacement containers 120.

Figure 20:
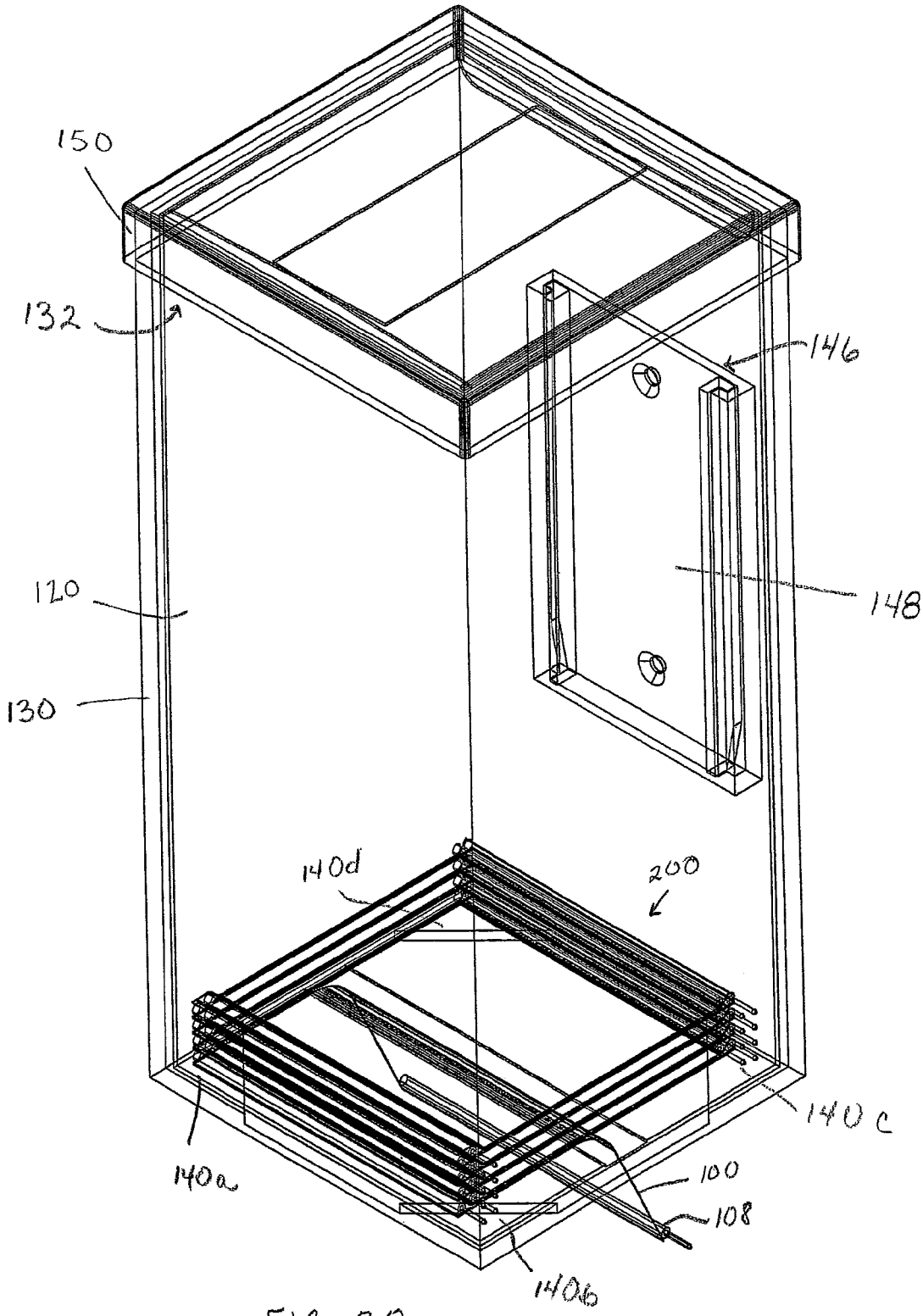
FIG. 20 shows a side perspective view of the combination dispenser and holding member of FIG. 18 including a removable lid and an attachment member for securing the dispenser to a wall.

As shown in FIGS. 18-20, at least one mounting member 146 is located along a sidewall portion 136. The at least one mounting member 146 is adapted for attachment to a vertical support surface, such as a wall, window, window frame, door frame, and the like. As shown in FIGS. 18 and 18A, the at least one mounting member 146 can comprise a plurality of openings adapted for cooperating with a nail, hook, screw, and the like extending from the vertical support surface. In another design, such as shown in FIG. 20, the at least one mounting member 146 comprises a plate 148 adapted for cooperating with a wall mount (not shown) in a well-known manner.

With continuing reference to FIG. 20, the combination dispenser and holding member 300 can include a removable lid 150, also formed from any well-known material, adapted for closing the top opening 132 of the holding member 130.

Figure 21:
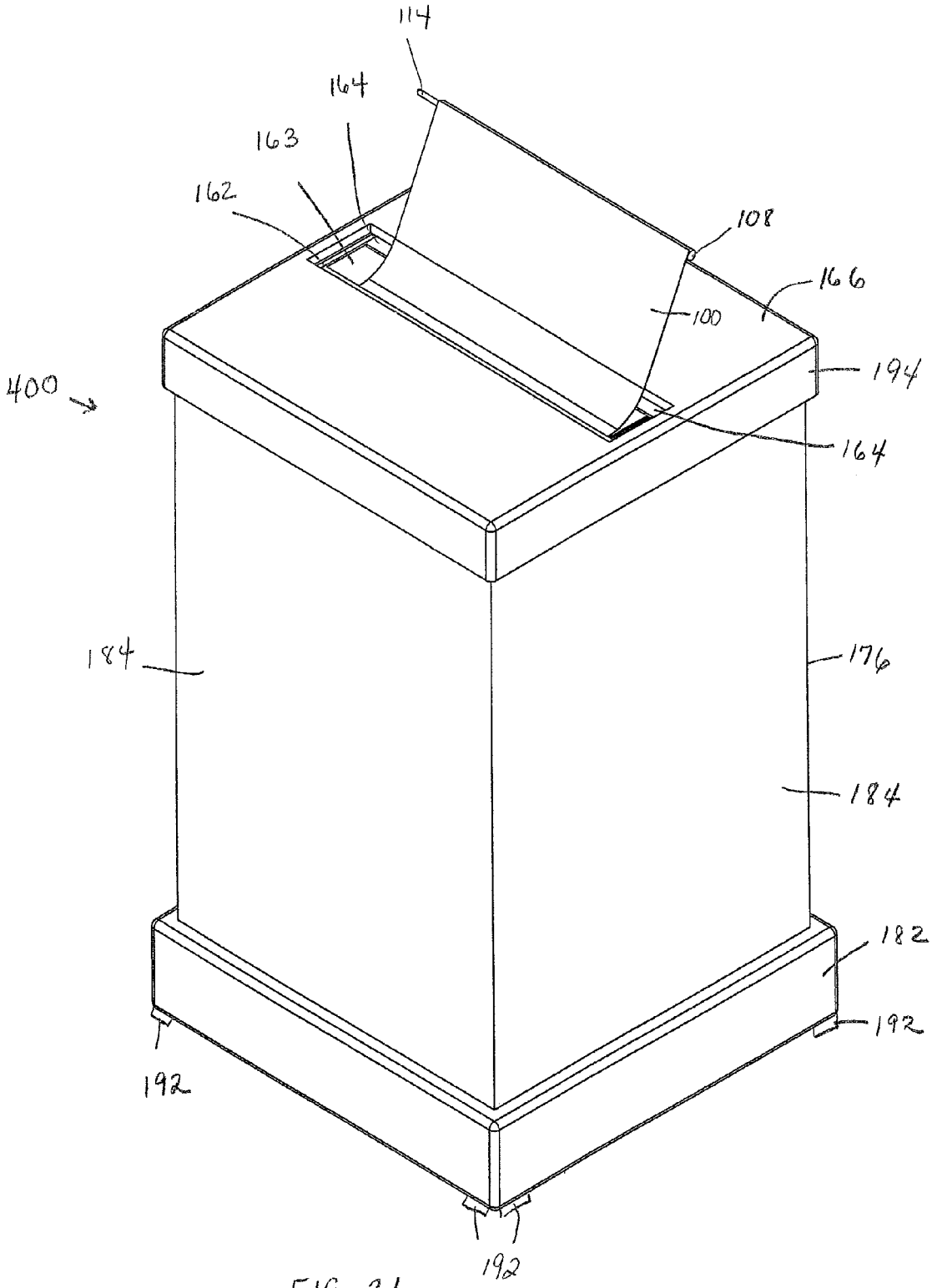
FIG. 21 shows a front perspective of a combination dispenser and holding member for dispensing a series of sanitary disposable writing instruments according to another design of the invention.

FIG. 21 shows an outer perspective view of a combination dispenser and holding member, generally indicated as 400, for dispensing a series of sanitary writing instruments 200 according to another design of the present invention. This design is particularly useful for placement on a horizontal surface, such as a desk top or a sign-in window, such as at a doctors' office, or a counter, such as at a bank, hotel, or check-out line.

Figure 21A:
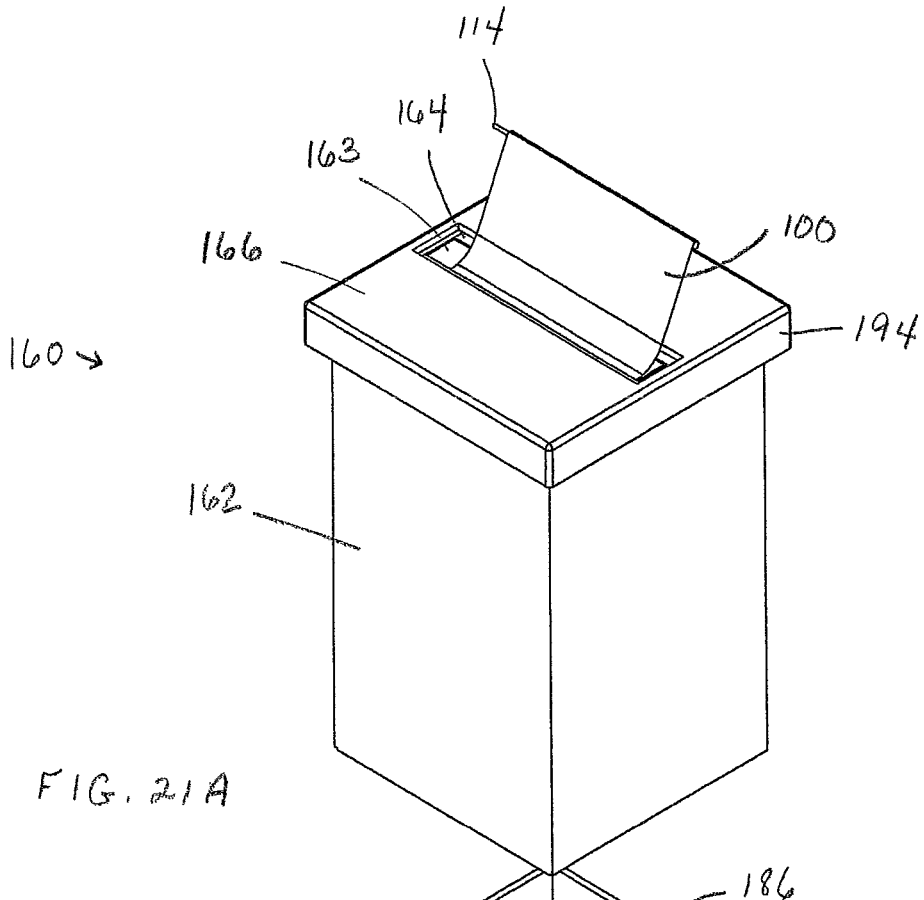
FIG. 21A shows a front perspective view of the dispenser of FIG. 21.
Figure 22:
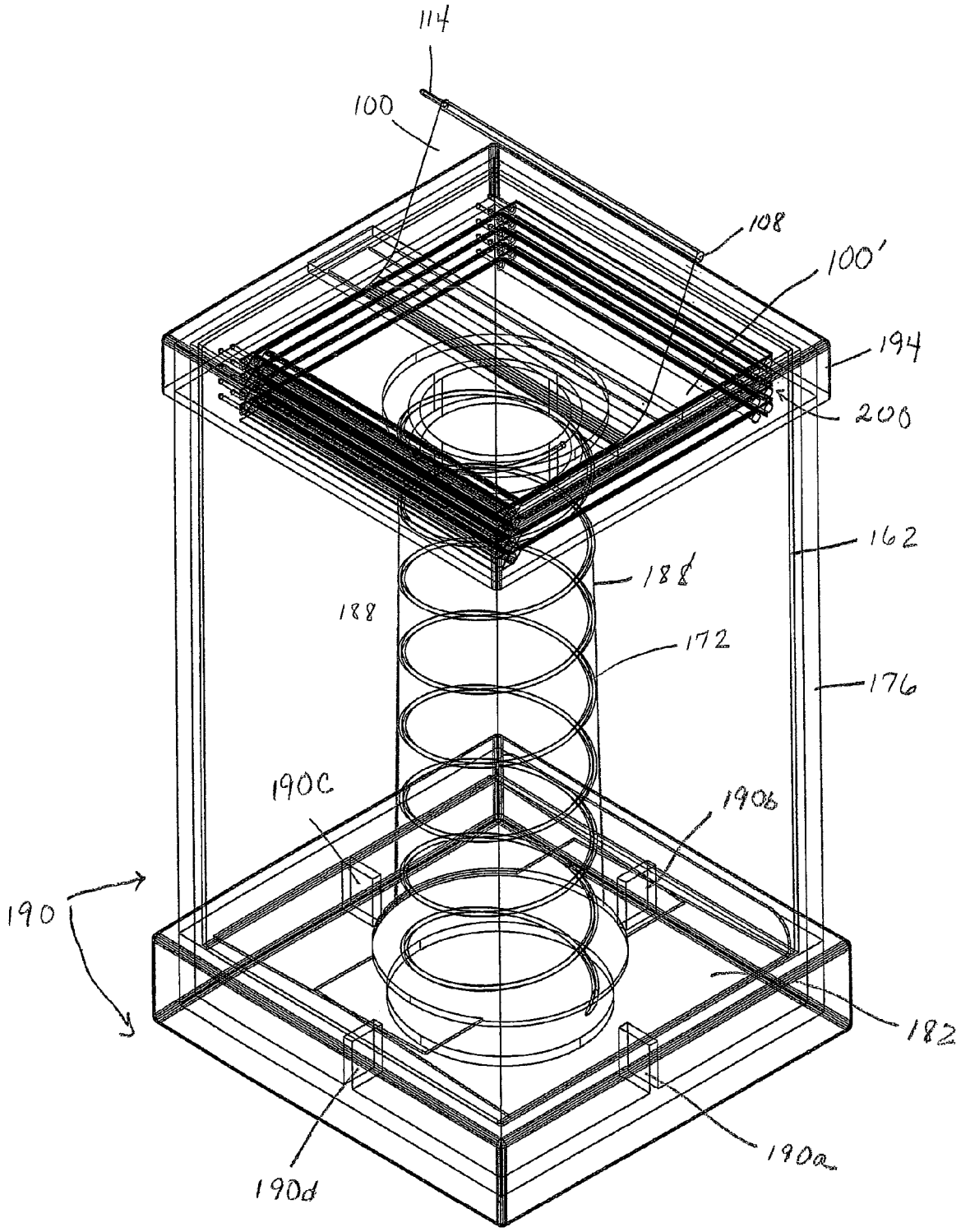
FIG. 22 shows a front perspective view of the combination dispenser and holding member of FIG. 21 including the interior components and contents of the dispenser/holding member.
Figures 22A, 22B:
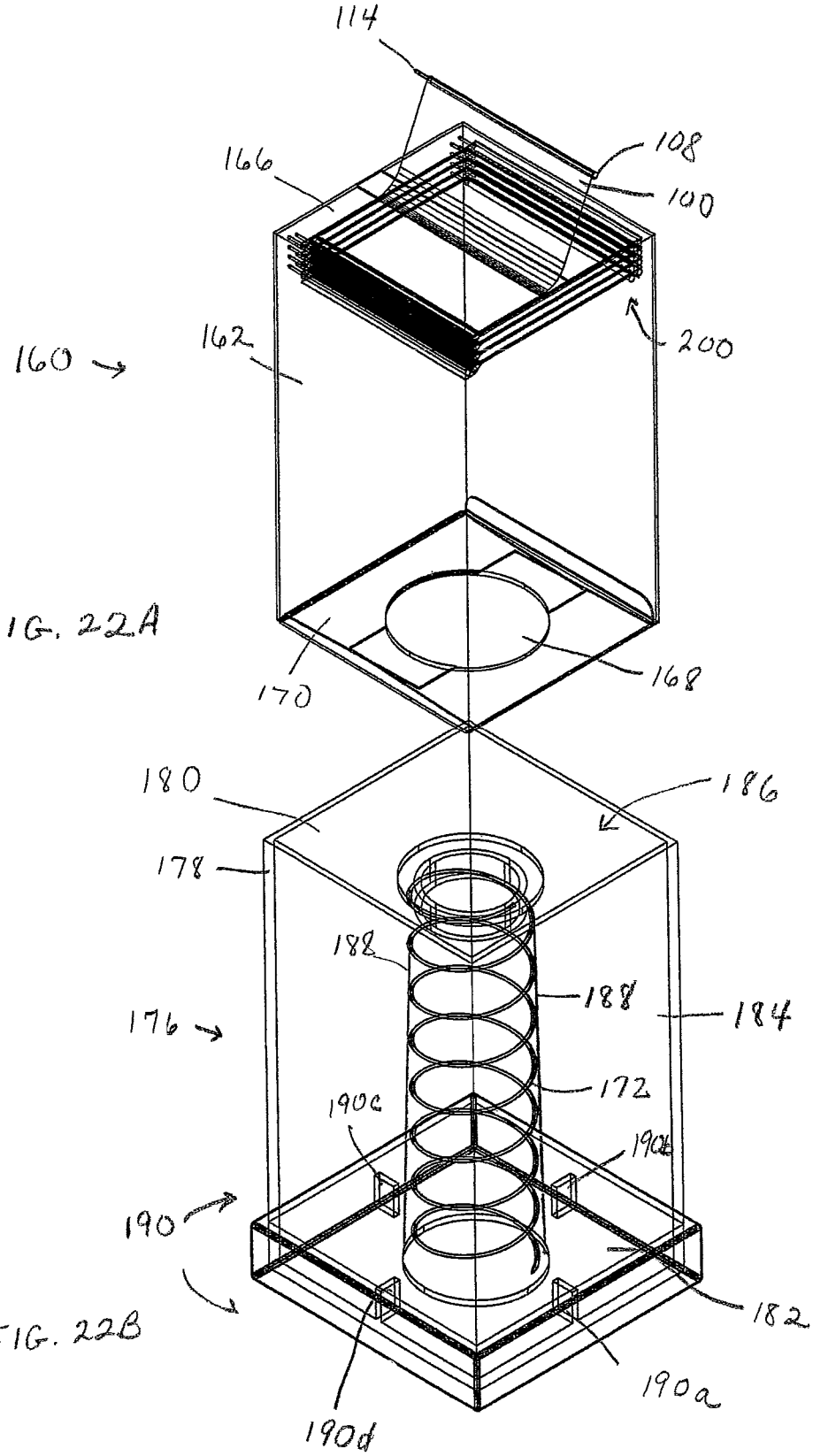
FIG. 22A shows a front perspective view of the dispenser of FIG. 22.
FIG. 22B shows a front perspective view of the holding member of FIG. 22.

With continuing reference to FIG. 21 and with reference to FIGS. 21A, 22 and 22A, the dispenser, generally indicated as 160 comprises a container 162 for holding the series of writing instruments 200. The container 162 at least partially encloses the series of writing instruments 200 so as to minimize contamination the writing instruments 100. As discussed above, the container 162 can be formed from any well-known, disposable material, such as cardboard or flexible plastic material to form a sleeve-like enclosure for containing the series of writing instruments 200. The container 162 includes an opening 163 extending therethrough for feeding the writing instruments.

A lid 194, which can be removable, can be provided having a top open portion 164 extending through a top portion 166 of the lid 194. This top open portion 164 is aligned with the opening 163 and is adapted for feeding the series of writing instruments 200, one at a time, there through to allow a user to remove a single writing instrument 100 from the combination dispenser and holding member 400, wherein removal of this single writing instrument 100 positions a subsequent writing instrument 100' for removal from the combination dispenser and holding member 400. As shown in FIG. 22A, a bottom open portion 168 extends through a bottom portion 170 of the container 160. The bottom open portion 168 is adapted for receiving a biasing member therein.

Figure 21B:
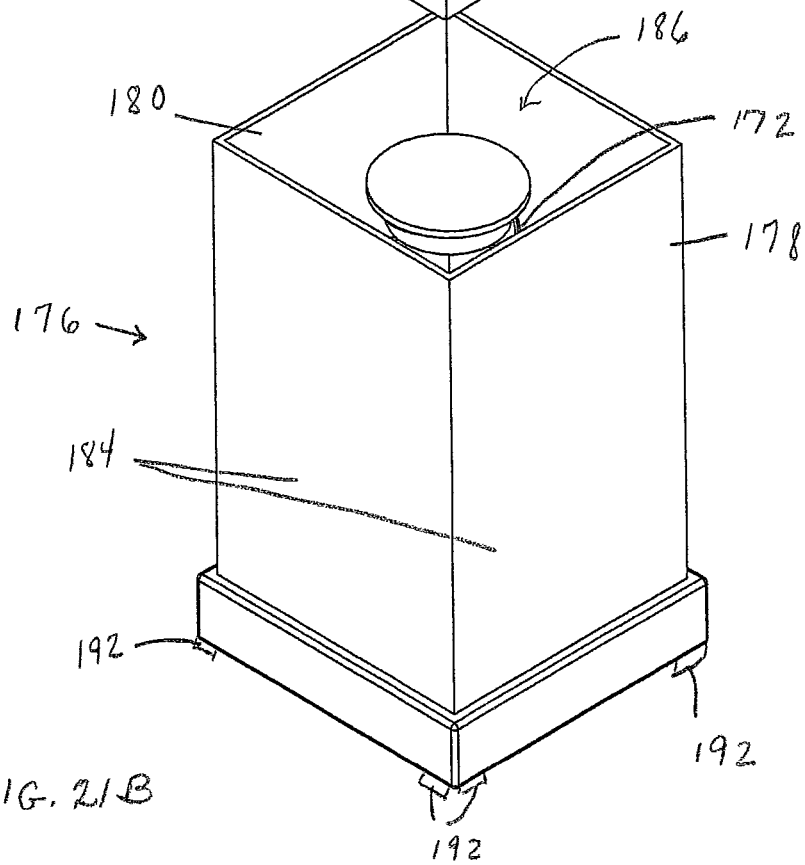
FIG. 21B shows a front perspective view of the holding member of FIG. 21.

With reference to FIGS. 21B and 22B, a cylindrical holding member generally indicated as 176 is provided having a top portion 178 including an opening 180 extending there through, a bottom closed portion 182, and sidewalls 184 extending between the top portion 178 and the bottom closed portion 182. The top portion 178, bottom closed portion 182 and sidewalls 184 define a space, generally indicated as 186, adapted for receiving the container 162 and adapted for removal of the container 162 during replacement of the container 162. The top opening 164 is provided in the lid 194 and is in alignment with opening 163 in the container 162 such that one can access and/or remove the individual writing instruments 100 from the series of writing instruments 200. Upon depletion of the series of writing instruments 200 from the container 162, the lid 194 can be removed from the cylindrical holding member 176 and the container 162 can be removed and replaced with a new container 162 filled with another series of writing instruments 200.

According to the design shown in FIGS. 22, 22A, and 22B, a biasing member, such as a spring 172, can be associated with the cylindrical holding member 176. This biasing member or spring 172 is adapted for entering within the bottom open portion 168 of the container 162 and applying a biasing force to the series of writing instruments 200. According to one embodiment, the biasing member or spring 172 is attached to the bottom closed portion 182 of the cylindrical holding member. Spring support members 188 as shown in FIGS. 22 and 22B, can be provided for supporting the spring against tilting to one side and also to prevent stretching of the spring. Although the drawings show a spring 172 as the biasing member, it can be appreciated that any known type of biasing member may be used in the present invention.

At least one coil binding stop 190 may be associated with the spring to prevent or stop the downward motion of the container 162 during placement within the holding member, to prevent the spring 172 from entering too far within the container and applying too great of a force to the series of writing instruments 200. The at least one coil binding stop 190 can include a plurality of stop members 190*a*, 190*b*, 190*c*, and 190*d* positioned on the inside of the bottom closed portion 182 of the holding member. Alternatively, the at least one coil binding stop 190 or plurality of coil binding stops 190*a*-190*d* can be attached to an inside portion of the sidewalls 184 toward the bottom of the holding member 176.

Mounting members 192 may optionally be provided for mounting the combination dispensing and holding member 400 on the horizontal support surface. These mounting members 192 can be in the form of clips, adhesive pads, or any other known type of mounting members. Alternatively, the combination dispensing and holding member 400 may be placed onto the support surface without any type of mounting member. In this design, anti-slip rubber members may be positioned adjacent an outside surface of the bottom closed portion 182 of the holding member 176 to prevent the combination dispensing and holding member 400 from sliding off the support surface.

As stated above, the top portion 178 of the cylindrical holding member 176 can include a removable lid 194 mounted thereon which can be removed to facilitate the replacement of containers 162 therein.

Figure 23:
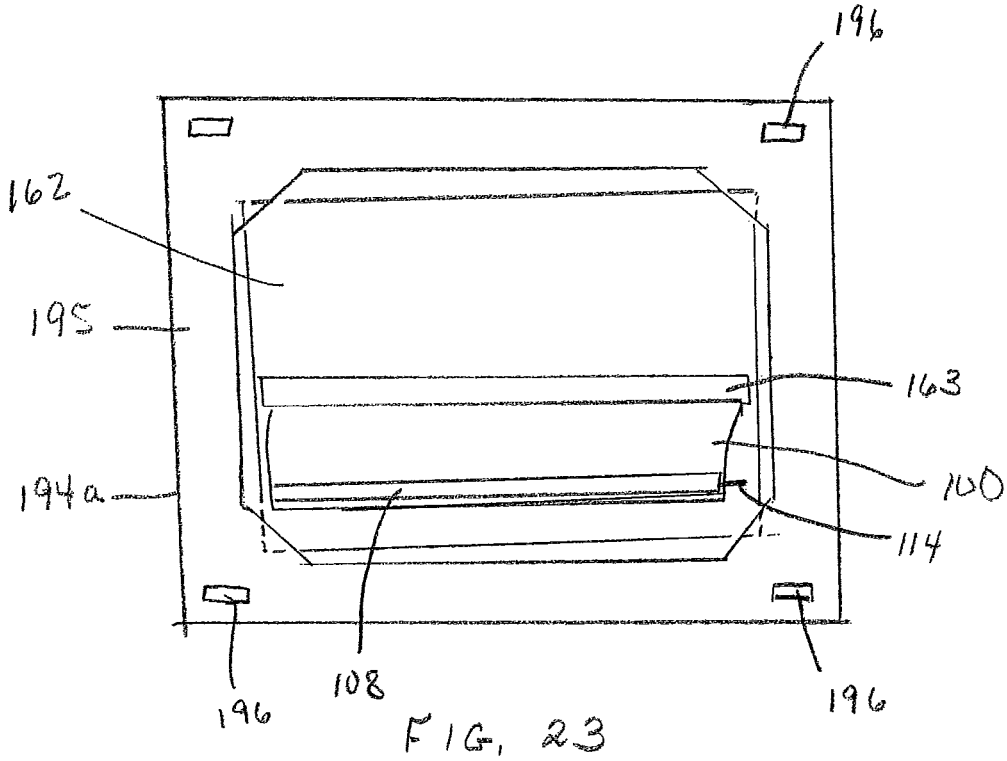
FIG. 23 shows a top view of a lid, according to an alternative design, which may be used with the combination dispenser and holding member of FIGS. 21 and 22.

Reference is now made to FIG. 23 which shows a lid 194*a*, according to an alternative design, which may be used with the combination dispenser and holding member of FIGS. 21 and/or 22. The lid 194*a* comprises a large opening 164*a* extending through the top portion 166*a* of the lid 194*a*. This large opening would leave the majority of the top portion of container 162 exposed and allow for easy access to the opening 163 extending through container 162 as well as easier access to the writing instrument 100. The lid 194*a* includes a frame portion 195 which is sized slightly larger than the container 162, and may be shaped differently than the container 162, such as in the size of a hexagon and the like, so as to prevent inadvertent removal of the container 162 from the holding member. A plurality of snaps 196 may be provided for cooperation with the top portion 178 of the cylindrical member 176, as shown in FIGS. 21B and 22B, for securing the lid 194*a* to the cylindrical member 176.

The holding member 176 can be formed from any well-known material, such as a hard plastic material. The material can be of any color, transparency or translucency and/or include any type of indicia thereon, such as advertising information, holiday décor, decorative designs, and the like.

As discussed in detail above, the invention provides a novel and inexpensive sanitary disposable writing instrument, a dispenser therefore and a method of producing the writing instrument that minimizes the transfer of bacteria, viruses, chemicals and numerous other contaminants from one person to another.

The invention has been described in such full, clear, concise, and exact terms so as to enable any person skilled in the art to which it pertains to make and use the same. It should be understood that variations, modifications, equivalents and substitutions for components of the specifically described embodiments of the invention may be made by those skilled in the art without departing from the spirit and scope of the invention as set forth in the appended claims. Persons who possess such skill will also recognize that the foregoing description is merely illustrative and not intended to limit any of the ensuing claims to any particular narrow interpretation.

The invention claimed is:

1. A sanitary disposable writing instrument for minimizing the transfer of bacteria, viruses and/or chemicals from one person to another, said sanitary disposable writing instrument comprising;

a. a strip of flexible holding material, said strip of flexible holding material comprising a first portion and a second portion, said first portion and said second portion extending in a parallel direction with respect to each other;

b. a writing implement extending parallel with said first portion and being removably secured to one side of the flexible holding material, said writing implement comprising a cylindrical member having at least a first end extending along and removably secured to the first portion of the one side of the holding material;

c. a writing tip associated with the writing implement, wherein the writing implement is accessible and adapted for removal from the one side of the flexible holding material and the cylindrical member forms a grasping surface for manipulation of the writing implement; and d. at least a second writing instrument secured thereto to form a series of sanitary disposable writing instruments, wherein said series of writing instruments are stacked on top of each other to form a stack of writing instruments, and wherein the series of writing instruments are secured together with adhesive along alternating edge portions of the flexible material such that removal of a first writing instrument and its associated flexible holding material causes a second writing instrument and its associated flexible holding material to become positioned for removal from the stack.

2. The writing instrument of claim 1 wherein writing implement includes a second end and said writing tip is associated with said second end of said writing implement and wherein manipulation of the writing implement enables writing with said writing tip.

3. The writing instrument of claim 1 wherein said writing implement is removably secured to said one side of the holding material with one of a rubber cement and a pressure sensitive adhesive.

4. The writing instrument of claim 1 wherein at least said second portion of said holding material includes written material thereon.

5. The writing instrument of claim 1 wherein said strip of flexible holding material is formed from a material selected from the group consisting of paper, plastic, and synthetic rubber and the writing instrument is subsequently removed from the flexible holding material to enable the cylindrical member to form the grasping surface for manipulation of the writing implement.

6. A system for dispensing a series of sanitary writing instruments comprising;

a. a first strip of flexible holding material, said strip of flexible holding material comprising a first portion and a second portion, a writing implement held by one side of said holding material, said writing implement comprising a cylindrical member having at least a first end extending along, accessible, and adapted for removal from the one side of the flexible holding material removably secured to the first portion of the one side of the holding material, and a writing tip associated with said writing implement, wherein the writing implement is adapted for removal from the flexible holding material and the cylindrical member forms a grasping surface for manipulation of the writing implement;

b. at least a second strip of flexible holding material including a writing implement secured thereto to form the series of sanitary disposable writing instruments, wherein said series of writing instruments are stacked on top of each other to form a stack of writing instruments, and wherein the series of writing instruments are secured together with adhesive along alternating edge portions of the flexible material such that removal of a first writing instrument and its associated flexible holding material causes a second writing instrument and its associated flexible holding material to become positioned for removal from the stack;

c. a dispenser comprising a container for holding said series of writing instruments, said container at least partially enclosing said series of writing instruments so as to minimize contamination of said writing instruments;

d. an open portion extending through a bottom portion of said container, said open portion adapted for feeding said series of writing instruments there through and allowing a user to remove a single writing instrument from said container wherein removal of said single writing instrument positions a subsequent writing instrument for removal from said open portion;

e. a holding member having a top opening, a bottom opening, and sidewalls extending between said top opening and said bottom opening, said top opening, bottom opening and sidewalls defining a space adapted for receiving said container, said bottom opening adapted for cooperation with said open portion in said bottom portion of said container to allow access to and removal of said writing instruments; and f. at least one stop member located with respect to said bottom opening of said holding member to retain said container within said holding member.

7. The system of claim 6 wherein said at least one stop member comprises a plurality of stop members located adjacent said bottom opening of said holding member.

8. The system of claim 6 wherein said at least one stop member comprises a reduced opening perimeter within said bottom opening of said holding member wherein said reduced opening perimeter is smaller in size than a perimeter of said bottom portion of said container.

9. The system of claim 6 including at least one mounting member located along a sidewall portion, said at least one mounting member adapted for attachment to a vertical support surface.

10. The system of claim 9 wherein said at least one mounting member comprises a plate adapted for cooperating with a wall mount.

11. The system of claim 6 wherein said holding member is adapted for receiving replacement containers.

12. The system of claim 6 including a removable lid having an opening extending therethrough, said lid being adapted for closing said top opening of said holding member.

13. The system of claim 6 wherein said strip of flexible holding material is formed from a material selected from the group consisting of paper, plastic, and synthetic rubber and the writing instrument is subsequently removed from the flexible holding material to enable the cylindrical member to form the grasping surface for manipulation of the writing implement.

14. A system for dispensing a series of sanitary writing instruments comprising;

a. a first strip of flexible holding material, said strip of flexible holding material comprising a first portion and a second portion, a writing implement held by one side of said holding material, said writing implement comprising a cylindrical member having at least a first end extending along, accessible, and removably secured to the first portion of the one side of the holding material, and a writing tip associated with said writing implement, wherein the writing implement is adapted for removal from the one side of the flexible holding material and the cylindrical member forms a grasping surface for manipulation of the writing implement;

b. at least a second strip of flexible holding material including a writing implement secured thereto to form the series of sanitary disposable writing instruments, wherein said series of writing instruments are stacked on top of each other to form a stack of writing instruments, and wherein the series of writing instruments are secured together with adhesive along alternating edge portions of the flexible material such that removal of a first writing instrument and its associated flexible holding material causes a second writing instrument and its associated flexible holding material to become positioned for removal from the stack c. a dispenser comprising a container for holding said series of writing instruments, said container at least partially enclosing said series of writing instruments so as to minimize contamination said writing instruments;

d. a top open portion extending through a top portion of said container, said top open portion adapted for feeding said series of writing instruments there through and allowing a user to remove a single writing instrument from said container wherein removal of said single writing instrument positions a subsequent writing instrument for removal from said open portion;

e. a bottom open portion extending through a bottom portion of said container, said bottom open portion adapted for receiving a biasing member therein;

f. a holding member having a top portion including an opening extending there through, a bottom closed portion, and sidewalls extending between said top portion and said bottom portion, said top portion, bottom portion and sidewalls defining a space adapted for receiving said container, said top opening adapted for cooperation with said top open portion of said container to allow access to and removal of said writing instruments; and g. a biasing member associated with said holding member, said biasing member adapted for entering within said bottom open portion of said container and applying a biasing force to said series of writing instruments.

15. The system of claim 14 wherein said biasing member is attached to bottom closed portion of said holding member.

16. The system of claim 14 wherein said biasing member comprises a spring.

17. The system of claim 16 including spring support members for supporting said spring against tilting and preventing stretching of said spring.

18. The system of claim 16 including at least one coil binding stop associated with said spring.

19. The system of claim 14 including mounting members for mounting said holding member on a horizontal support surface.

20. The system of claim 14 wherein said top portion of said holding member comprises a removable lid having an opening extending therethrough and said holding member is adapted for receiving replacement containers therein.

21. The system of claim 14 wherein said strip of flexible holding material is formed from a material selected from the group consisting of paper, plastic, and synthetic rubber and the writing instrument is subsequently removed from the flexible holding material to enable the cylindrical member to form the grasping surface for manipulation of the writing implement.

* * * * *